US008816800B2

(12) United States Patent
Mikl

(10) Patent No.: US 8,816,800 B2
(45) Date of Patent: Aug. 26, 2014

(54) RELAY WITH AN IMPROVED CONTACT SPRING

(75) Inventor: Rudolf Mikl, Arbesthal (AT)

(73) Assignee: Tyco Electronics Austria GmbH, Vienna (AT)

( * ) Notice: Subject to any disclaimer, the term of this patent is extended or adjusted under 35 U.S.C. 154(b) by 0 days.

(21) Appl. No.: 13/324,181

(22) Filed: Dec. 13, 2011

(65) Prior Publication Data

US 2012/0154077 A1 Jun. 21, 2012

(30) Foreign Application Priority Data

Dec. 16, 2010 (DE) ..... 10 2010 063 229

(51) Int. Cl.
*H01H 51/22* (2006.01)

(52) U.S. Cl.
USPC ..... 335/83

(58) Field of Classification Search
USPC ..... 335/83
See application file for complete search history.

(56) References Cited

U.S. PATENT DOCUMENTS

| | | | | |
|---|---|---|---|---|
| 5,160,910 | A | 11/1992 | Tsuji | |
| 6,496,090 | B1 * | 12/2002 | Nishida et al. | 335/202 |
| 6,816,044 | B2 * | 11/2004 | Mader et al. | 335/129 |
| 6,903,639 | B2 * | 6/2005 | Sanada et al. | 335/129 |
| 7,358,839 | B2 | 4/2008 | Mikl | |
| 2002/0024412 | A1 * | 2/2002 | Wu | 335/129 |
| 2002/0175787 | A1 * | 11/2002 | Mader et al. | 335/131 |
| 2005/0190026 | A1 * | 9/2005 | Mikl | 335/128 |
| 2006/0181376 | A1 * | 8/2006 | Mikl et al. | 335/78 |
| 2007/0257752 | A1 * | 11/2007 | Mikl et al. | 335/78 |

FOREIGN PATENT DOCUMENTS

| | | | |
|---|---|---|---|
| DE | 102004060370 | A1 | 7/2006 |
| DE | 102006021203 | B3 | 1/2008 |

OTHER PUBLICATIONS

Search Report issued by the German Patent and Trademark Office dated Aug. 30, 2011, for Priority Application DE 102010063229.5; 8 pages.

* cited by examiner

*Primary Examiner* — Mohamad Musleh
(74) *Attorney, Agent, or Firm* — Faegre Baker Daniels LLP

(57) ABSTRACT

An electromagnetic relay with at least one moveable contact spring, having an assigned normally-open contact, wherein the moveable contact spring is connected electrically-conductively to a first electrical terminal and the normally-open contact is connected electrically-conductively to a further electrical terminal, having a moveably mounted actuating element to move the moveable contact spring as a function of the current flowing through the relay in contact with the normally-open contact. The contact spring is equipped with two abutment surfaces, which are spatially separated from one another, and that the actuating element is equipped with two actuating surfaces, which are brought into active connection with the two abutment surfaces in order to move the contact spring.

25 Claims, 6 Drawing Sheets

RELAY WITH AN IMPROVED CONTACT SPRING

BACKGROUND OF THE INVENTION

1. Field of Invention

The invention relates to an electromagnetic relay according to claim 1.

2. Related Art to the Invention

Electromagnetic relays are known from, for example, DE 10 2007 024 128 A1. Described in DE 10 2007 024 128 A1 is an electromagnetic relay in which, depending on the current flowing through the relay, the armature can assume two different positions. The armature is connected to a moveable contact via a carrier. The moveable contact is moveably mounted on the relay via a spring. Depending on the position of the armature, the moveable contact is propelled towards or drawn away from a normally-open contact.

The object of the invention is to provide an improved relay. In particular, the functionality is to be enabled by an improved contact spring and an improved actuation of the contact spring.

BRIEF SUMMARY OF THE INVENTION

The object of the invention is achieved by the relay according to claim 1. One advantage of the relay according to the invention lies in the fact that the spring of the moveable contact can be actuated symmetrically. Consequently, on the one hand, the loading on the contact spring is reduced and, on the other, an improved movement of the moveable contact is achieved. For the improved movement of the moveable contact, the contact spring is equipped with two sprung arms, with which the actuating element simultaneously engages.

Developments of the invention are disclosed in the dependent claims.

In one development of the relay, the two abutment surfaces are, in relation to a contact of the moveable contact spring, disposed on opposing sides of the moveable contact spring. A uniform movement of the contact spring in the region of the contact is achieved in this manner.

In a further embodiment, the two abutment surfaces are disposed at an identical height in the region of the contact of the moveable contact spring. Owing to the identical height of the abutment surfaces, a bending moment of equal magnitude is exerted on either side of the contact spring. Consequently, the actuation of the contact spring is performed more uniformly.

In a further embodiment, the abutment surfaces are provided on two sprung arms that extend laterally out from a base body of the moveable contact spring. Owing to the design of the sprung arms, firstly, sufficient space is available for the provision of the abutment surfaces and for the seating of the actuating element. In addition, initiation of the movement can take place irrespective of the position of the abutment surfaces on the base body. An actuating element of a simple design is thus possible and, moreover, a preferred initiation of the motive force into the moveable contact spring is ensured. Additionally, a cushioning of the actuation of the actuating element can take place via the sprung arms. The sprung arms take the form of e.g. thin metal strips, which likewise assume a spring-action function between the actuating element and the base body of the contact spring.

In a further embodiment, the sprung arms extend laterally out from the base body of the contact spring beneath the contact. The sprung arms carry the abutment surfaces right into the region of the contact where they are disposed at the side of the contact of the moveable contact spring, preferably with equal lateral spacing from the contact and preferably at an identical height. An improved force transmission between the actuating element and the contact of the contact spring is possible in this manner.

In a further embodiment, a third sprung arm is provided on the base body, wherein the third sprung arm ends opposite the first sprung arm and is disposed above the first sprung arm, and serves as a restricting element or guidance element in an upward direction for the actuating element. In this manner, any lifting of the actuating element upwards in the region of the contact spring is restricted. An improved movement of the actuating element, in particular an improved guidance of the actuating element, is thus possible.

In a further embodiment, the contact spring is equipped with a further abutment surface, wherein the abutment surface of the contact spring is assigned to an actuating surface of the actuating element. When the actuating surface seats against the abutment surface of the contact spring, the contact spring can be drawn away from an assigned normally-open contact. Consequently, the moveable contact spring can, especially following the fusing of the contact spring to a normally-open contact, be separated again from the normally-open contact.

In a further embodiment, the further abutment surface is provided on the same side of the contact as the second sprung arm. A compact, space-saving geometry of the contact spring is enabled in this manner. Moreover, with the aid of a simply structured actuating arm, the actuating element can actuate not only the second sprung arm but also the further abutment surface.

In a further embodiment, the housing is equipped with a housing cover, wherein the housing cover is equipped with a wall, wherein the wall is routed between the two moveable contact springs, and represents an electrically insulating wall between the two contact springs. In this manner, the distance between the two contact springs can be reduced without a voltage flashover taking place between the two contact springs.

In a further embodiment, the actuating element and/or the housing is equipped with a recess into which the wall of the housing cover projects. An insulating wall with a large surface area is enabled in this manner. Moreover, the position of the insulating wall can be precisely defined by means of the recesses.

BRIEF DESCRIPTION OF THE DRAWINGS

The invention is described more fully below with reference to the drawings. The drawings show the following.

DETAILED DESCRIPTION OF THE INVENTION

Figure 1:
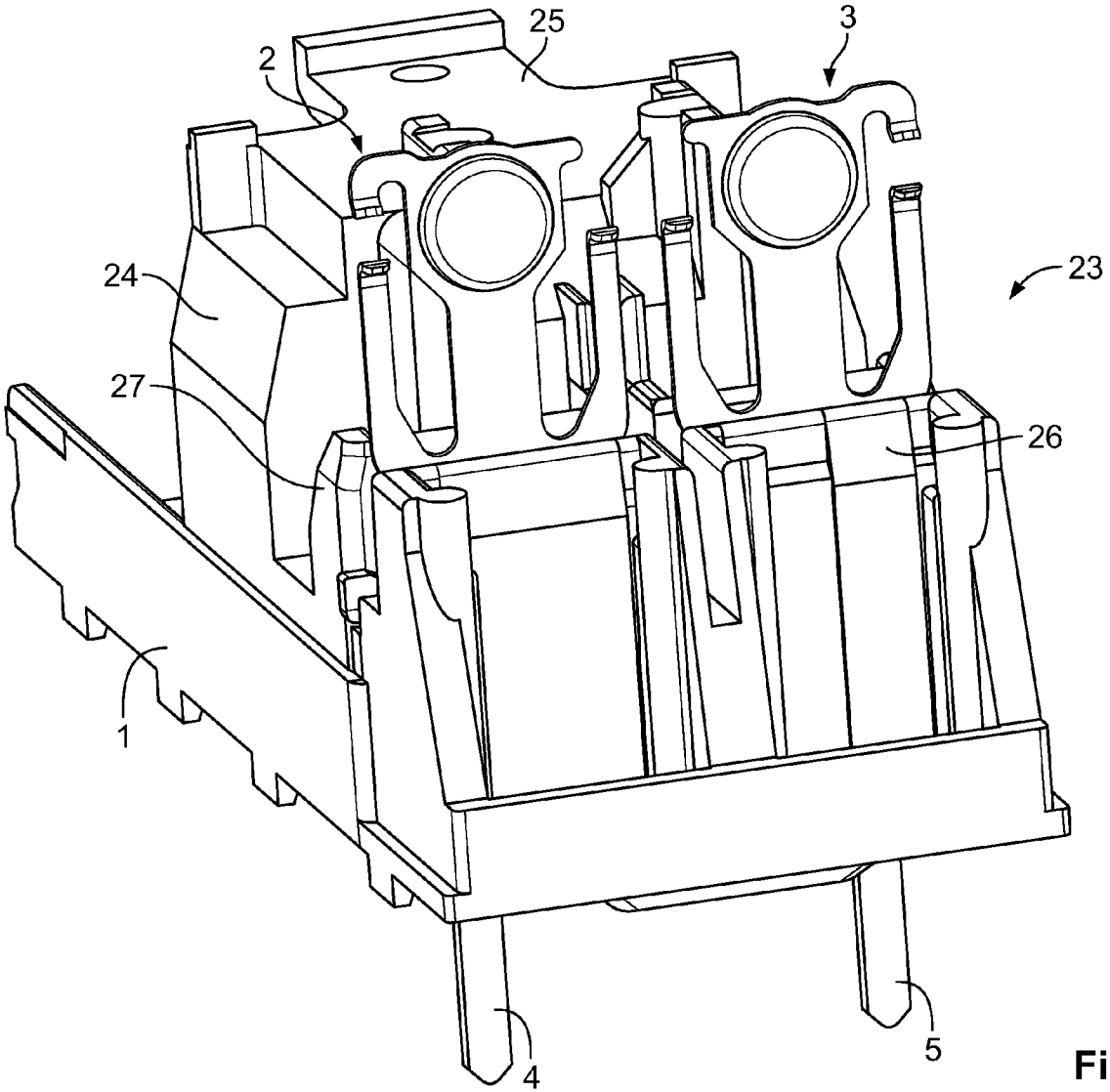
FIG. 1 a schematic partial view of an electromagnetic relay with two moveable contact springs, FIG. 2 a perspective view of the two moveable contact springs, FIG. 3 the electromagnetic relay from FIG. 1 with an actuating element, FIG. 4 a further perspective partial view of the electromagnetic relay from FIG. 3 with an insulating intermediate wall between the moveable contact springs, FIG. 5 a perspective partial view of the electrical relay with normally-closed contact springs and normally-open contact springs, FIG. 6 a further perspective partial view of the electromagnetic relay from FIG. 5.

FIG. 1 shows, in a perspective partial view, components of a relay 23 with a housing base 1 on which is disposed an electromagnetic coil 24. Provided in front of the electromagnetic coil 24 are a first and a second moveable contact spring 2, 3, which are moveably fastened to the housing base 1. The moveable contact springs 2, 3 are electrically connected to separate electrical terminals 4, 5, which project from the underside of the housing base 1. Provided above the electromagnetic coil 24 is a support surface 25 for an actuating element, which is not shown. The two contact springs 2, 3 are disposed to be in mirror-symmetry and parallel with one another. The housing base 1 is equipped with a front wall 26, which, in the view shown in FIG. 1, is disposed in front of the two contact springs 2, 3. The front wall 26 runs across the entire width of the housing base 1 and extends as far as half the height of the contact springs 2, 3. The housing base 1 is further equipped with a rear wall 27, which is disposed between the two contact springs 2, 3 of the electromagnetic coil 24. The rear wall 27 runs transversely over the entire width of the housing base 1 and extends as far as half the height of the contact springs 2, 3. The interspace between the front wall 26 and the rear wall 27 is calculated to be sufficiently large for the first and the second contact springs 2, 3 to be pivoted from a resting position into an operational position.

Figure 2:
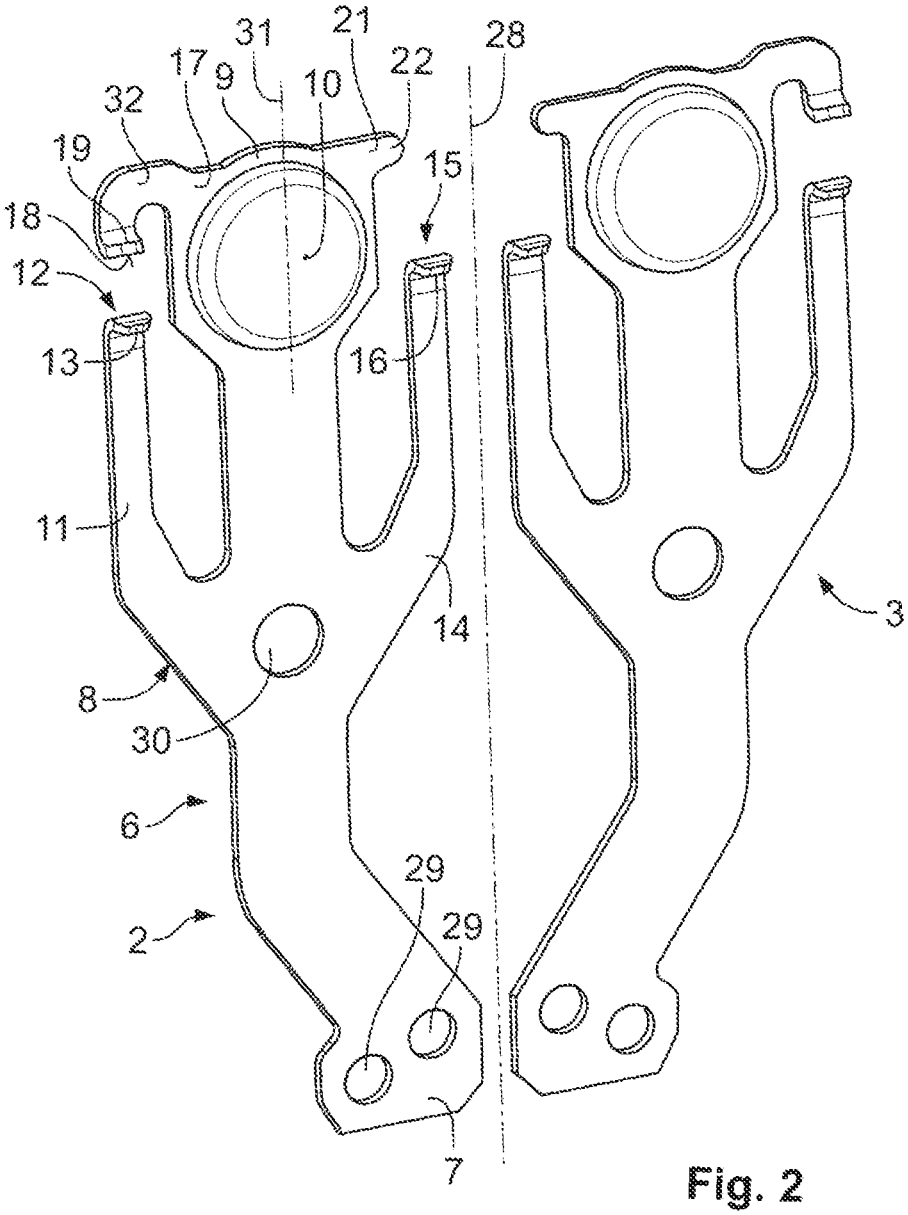

FIG. 2 shows the first and the second contact springs 2, 3, which, in the embodiment example shown, are of identical design but take a mirror-symmetrical form relative to a central plane 28. Depending on the selected embodiment, the two contact springs 2, 3 may also differ in design, or the relay 23 may also be equipped with just one single moveable contact spring. The shape of the first and second contact springs is explained by reference to the example of the first contact spring 1. The first contact spring 1 is equipped with a base body 6, which extends from a lower fastening region 7 via a central region 8 to a contact region 9 in the form of an elongated strip. Fastened to the contact region 9 is a contact rivet 10. Provided in the fastening region 7 are two holes 29, which are used for fastening the first contact spring 2 to the housing base 1. Starting from the fastening region 7, the base body 6 extends at an angle of 30° to the left relative to the central plane 28, as far as a lower portion of the central region 8. Starting from the central region 8, the base body 6 extends straight upwards in parallel with the central plane 28 as far as the contact region 9. Depending on the selected embodiment, the base body 6 may also take the form of a continuous straight strip from the fastening region 7 to the contact region 9.

Inserted in the central region 8 is a further hole 30, which improves the spring-action property of the base body 6. Furthermore, a first and a second sprung arm 11, 14 respectively extend laterally outwards from the central region 8 on opposite sides of the central region 8. The first and the second sprung arm 11, 14 run upwards in the direction of the contact region 9 in substantially parallel alignment with the upper portion of the central region 8 of the base body. In the embodiment example shown, the contact region 9 is of a wider design relative to the central region 8, in order to provide a sufficiently large surface for the contact rivet 10.

The first and the second sprung arm 11, 14 run laterally relative to the central region 8 as far as the level of the contact region 9. In the embodiment shown, the first and the second sprung arms 11, 14 end slightly beneath the centre of the contact rivet 10. Depending on the selected embodiment, the first and the second sprung arms 11, 14 may also run upwards past the centre of the contact rivet 10. Furthermore, in a further embodiment, the first and the second sprung arms may be of a shorter design and end below the contact region 9. The first and the second sprung arms 11, 14 exhibit an equally sized lateral separation relative to a central axis 31 of the contact region 9. Further, in the embodiment shown, the first and the second sprung arms 11, 14 end respectively in a first and a second bend region 13, 16. The first and the second bend regions 13, 16 take the form of a 90° bend forwards out of the image plane. The first and the second bend regions 13, 16 are equipped respectively, on a rear face, with a first and a second abutment surface 12, 15. Depending on the selected embodiment, the first and the second bend regions 13, 16 may also be dispensed with.

Furthermore, the sprung arms 11, 14 may, depending on the selected embodiment, also extend out from the base body 6 further down, i.e. closer to the fastening region 7, or else may extend out from the base body 6 further up, i.e. closer to the contact region 9. In one simple embodiment, the first and the second sprung arms 11, 14 may take the form of lugs emerging laterally from the contact region 9, with appropriate first and second abutment surfaces 12, 15. The length of the sprung arms and the geometry of the sprung arms 11, 14 influences the switching behaviour of the moveable contact springs 2, 3 and is selected according to the desired switching characteristics.

Additionally provided on the first contact spring 2 is a third sprung arm 17, which extends out from the contact region 9 of the base body 6 above the first sprung arm 11. The third sprung arm 17 extends laterally out from the contact region 9 and, in a further portion 32, runs parallel with the longitudinal dimension of the first contact spring 2 and in the direction of the first sprung arm 11. The further portion 32 ends at a defined distance from the first sprung arm 11 with a third bend region 19. The third bend region 19 takes the form of a 90° bend, which is directed forwards out of the image plane. Furthermore, a third abutment surface 18 is provided on an underside of the third bend region 19. Depending on the selected embodiment, the third sprung arm 17 may also take a different form. Realised between the third sprung arm 17 and the first sprung arm 11 is a receiving space 20.

The contact region 9 is also equipped with a lug 21, disposed opposite the third sprung arm 17 and projecting laterally, which lug 21 is equipped on a front face with a fourth abutment surface 22. The lug 21 extends out from the contact region 9 above the second sprung arm 14. Alternatively to the embodiment shown in FIG. 2, the lug 21 may also be of a longer or shorter design. In particular, the fourth abutment surface 22 may also be provided directly on the contact region 9 without the provision of a separate lug 21.

The second contact spring 3 is mirror-symmetrical to the first contact spring 2 relative to the central plane 28. The first and second contact springs 2, 3 are composed of a flexible sheet-metal strip, which is, for example, integrally formed by stamping from one sheet.

Figure 3:
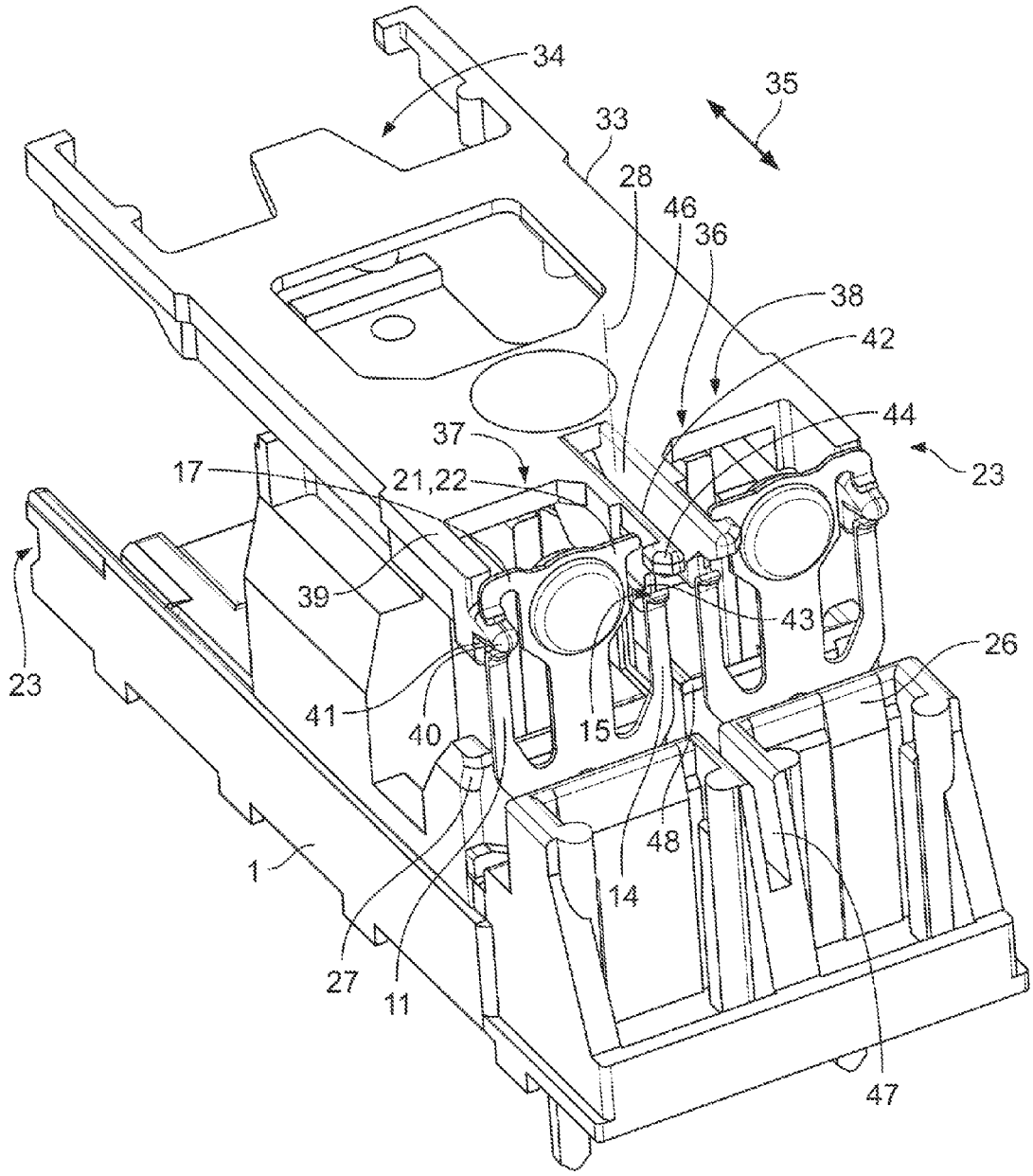

FIG. 3 shows the configuration from FIG. 1, wherein, however, an actuating element 33 is additionally disposed on the support surface 25. The actuating element 33 substantially takes the form of a structured panel, wherein a rear region 34, by means of which an armature (not shown) of the relay 23 is brought into active connection with the actuating element 33, is provided. Depending on the current flowing through the relay 23, the actuating element 33 is moved forwards or backwards in the direction indicated by the arrow 35. In a front portion 36, the actuating element 33 is equipped with a first action means 37 to move the first contact spring, and a second action means 38 to move the second contact spring 3. The first and second action means 37, 38 take a mirror-symmetrical form relative to central plane 28, which is disposed in the center of the relay 23 and follows the longitudinal direction of the relay. The first action means 37 is described more fully below. The first action means 37 is equipped with a first actuating arm 39, which projects forwards from the panel-shaped base body of the actuating element 33 in the direction of the contact spring 2. Provided in the front end region of the actuating arm 39 is a nose 40, which extends right into the receiving space 20 between the first and the third sprung arms 11, 17. Below the nose 40, the actuating arm 39 is equipped on a front face with a first actuating surface 41, which faces towards the first abutment surface 12 of the first sprung arm 11, i.e. is disposed substantially parallel with the first abutment surface 12 in the depicted resting position of the actuating element 33. The first action means 37 is further equipped with a second actuating arm 42, which likewise extends forwards from the panel-shaped base body of the actuating element 33 in the direction of the first contact spring 2. The second actuating arm 42 is disposed substantially parallel with the first actuating arm 39 and extends into the region of the second bend region 16 of the second sprung arm 14. The second actuating arm 42 is equipped on a front face with a second actuating surface 43, which is located opposite the second abutment surface 15 of the second sprung arm 14, i.e. is disposed parallel with the second abutment surface 15. The second actuating arm 42 is further equipped with a hook portion 44, which is disposed above the second sprung arm 14 and above the second actuating surface 43, and which extends forwards from the front face beyond the second actuating surface 43. The hook portion 44 is equipped with a third actuating surface 45, which faces towards the fourth abutment surface 22 and is disposed in front of the fourth abutment surface 22. Depending on the selected embodiment, the hook portion 44 may be dispensed with. In addition, the nose 40 may be dispensed with.

The second action means 38 is of a design symmetrical with the first action means 37, wherein a slit-shaped first recess 46 is formed between the first and the second action means 37, 38 in the actuating element 33. The first recess is disposed centrosymmetrically relative to the central plane 28. Furthermore, a second slit-shaped recess 47, which is disposed parallel with the first recess 46, is provided in the front wall 26. Additionally, the rear wall 27 is also equipped with a third recess 48, which is also slit-shaped and is disposed parallel to the first and second recesses in the central plane 28.

Figure 4:
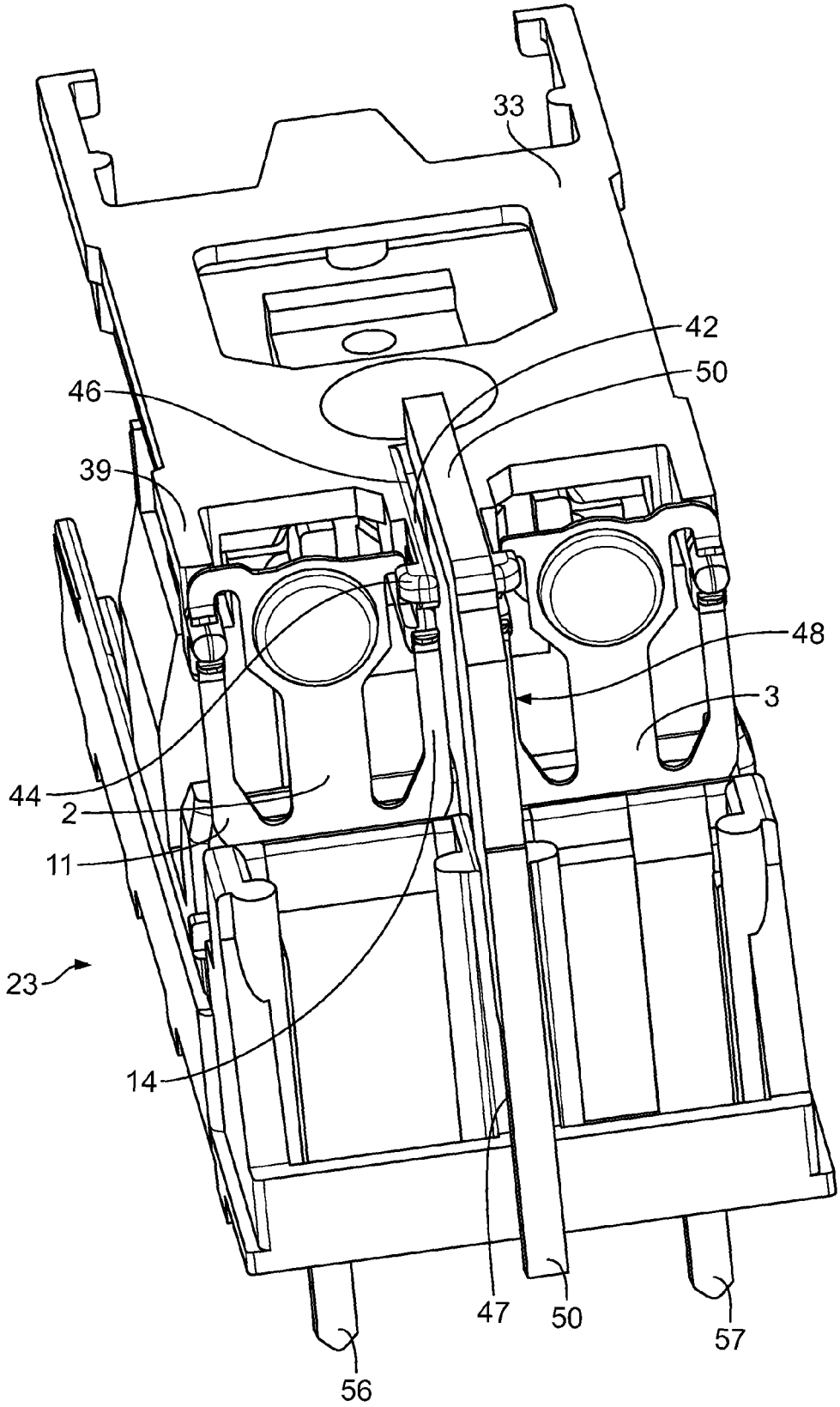

FIG. 4 shows a front view of the image from FIG. 3, wherein a wall 50 of a housing cover is shown. The housing cover is provided to cover the relay as a means of protection and is placed on the housing base 1. For reasons of clarity, the only part of the housing cover shown is the wall 50, which, starting from the box-shaped housing cover, projects inwards between the first and second contact springs 2, 3 and into the first, second and third recesses 46, 47, 48. The wall 50 preferably takes the form of a rectangular panel and is, like the housing cover, made from an electrically insulating material, in particular from plastics material. The wall 50 represents an insulating wall, which better electrically isolates the first and second contact springs 2, 3 from one another. The first recess 46 is of a configuration such that the movement of the actuating element 33 by means of the armature is not impeded by the wall 50.

Figure 5:
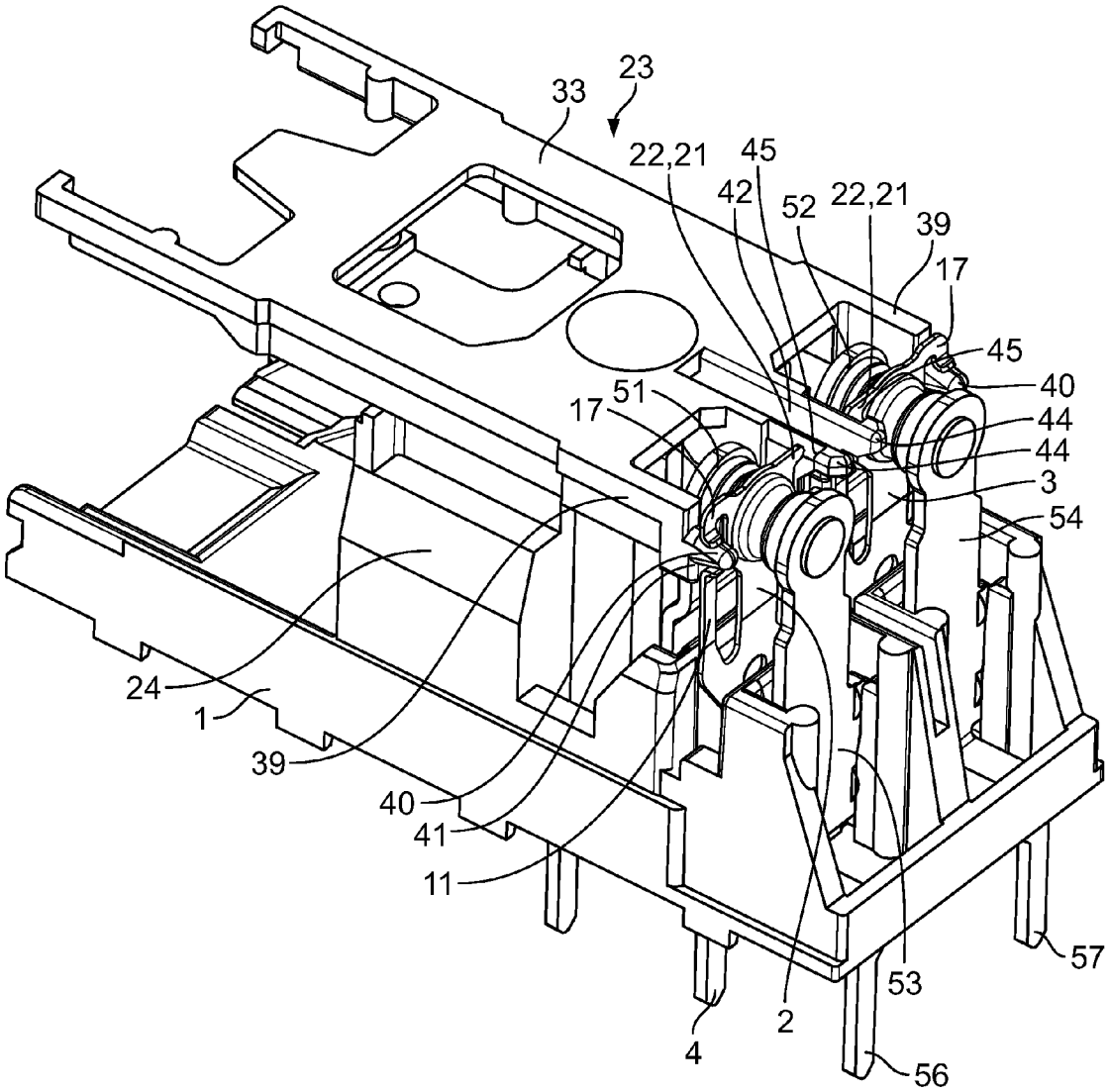

FIG. 5 shows the image from FIG. 3, wherein two normally-closed contact carriers 51, 52 are additionally provided, wherein the first normally-closed contact carrier 51 is disposed between the electromagnetic coil 24 and the first contact spring 2, and the second normally-closed contact carrier 52 is disposed between the electromagnetic coil 24 and the second contact spring 3. The normally-closed contact carriers 51, 52 serve for the seating of the first and second contact springs 2, 3 in a resting position. The first and second normally-closed contact carriers 51, 52 are disposed between the rear wall 27 and the electromagnetic coil 24. Further provided are a first and a second normally-open contact carrier 53, 54. The first and second normally-open contact carriers 53, 54 are disposed in front of the front wall 26 and connected to the housing base 1. The first and second normally-open contact carriers 53, 54 are each equipped with a further contact rivet 55, which faces towards the respective contact rivet 10 of the first or second contact spring 2, 3 respectively.

FIG. 5 shows the position in which the first and second contact springs 2, 3 are located in the resting position and are seated against the respective normally-closed contact carriers 51, 52. The first and second normally-open contact carriers 53, 54 are connected electrically-conductively to a third and a fourth electrical terminal 56, 57, which project in the form of pins from the underside of the housing base 1.

When the relevant current flows through the relay 23, the first and the second contact springs 2, 3 are, by means of the seating of the first actuating surface 41 of the first actuating arm 39 and the second actuating surface 43 of the second actuating arm 42 against the first abutment surface of the first sprung arm and the second abutment surface 15 of the second sprung arm 14 respectively, bent, with the contact regions 9, in the direction of the normally-open contact carriers 53, 54 until an electrical contact is established between the contact rivets 10 of the first and second contact springs 2, 3 and the respective contact rivets 55 of the normally-open contact carriers 53, 54.

If the current flow to the relay 23 is interrupted, the armature is returned to a resting position by pre-tensioning of the armature, wherein the armature additionally draws the actuating element 33 back to the resting position. As it is drawn back, the third actuating surface 45 of the hook portion 44 of the second actuating arm 42 engages with the fourth abutment surfaces 22 of the lugs 21, and, where for example the first and second contact springs 2, 3 are respectively stuck fast to the assigned normally-open contact carriers 53, 54, actively draws the first and second contact springs 2, 3 back into the resting position. In this manner, a fused electrical contact rivet 10 of a first and/or second contact spring 2, 3 can be mechanically separated from the relevant normally-open contact with the aid of the hook portion 44. In addition, the bent spring contacts 2, 3 spring back into the resting position.

As two contact springs 2, 3 are provided, it may happen that, for example, just one contact spring 2 fuses with the normally-open contact. Owing to the pretensioning, the other contact spring 3 springs back into the resting position and thereby, in addition to the armature, additionally moves the actuating element 33 in the direction of the resting position owing to the seating of the abutment surface against the actuating surface of the first actuating arm. In this manner, the separation force for separating the fused contact spring 2 is increased.

Figure 6:
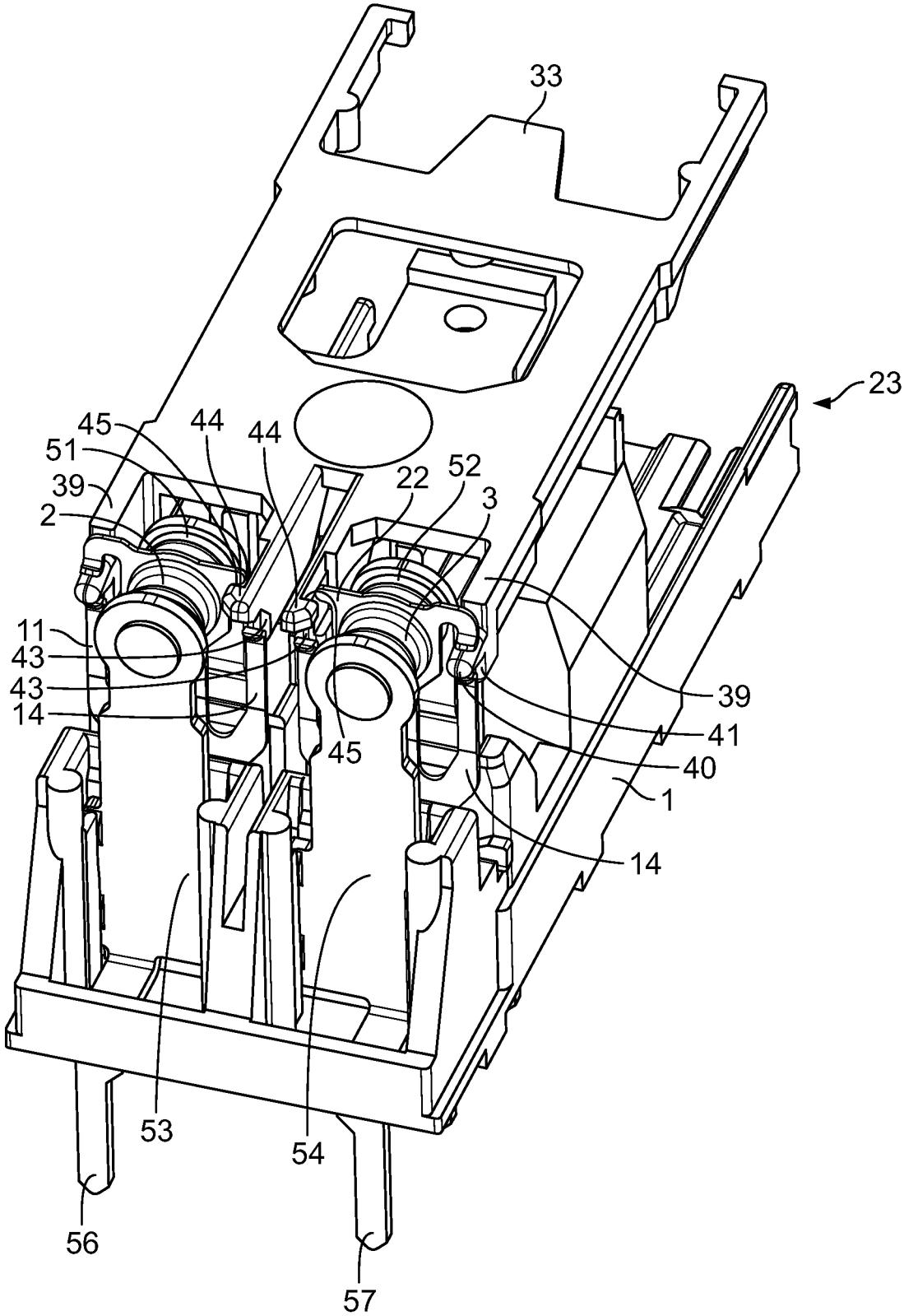

FIG. 6 shows a further perspective view of the figure, wherein the shape of the hook portion 44 and the shape of the second actuating arm 42 with the second actuating surface 43 can be clearly seen.

The unseen armature is preferably pretensioned in a resting position by a spring means. When the relevant current flows through the relay 23, the armature, interacting with a yoke and a core of the electromagnetic coil 24, is moved into an operating position during which the armature also moves the actuating element 33 into an operating position in a forward direction, i.e. in the direction of the normally-open contact carriers 53, 54. If the current flow is interrupted, the armature is pivoted back into the resting position by spring pre-tensioning, wherein the actuating element 33 is also moved back into the resting position by the armature. The actuating element 33 represents a slider, also known as a carrier. The normally-closed contact carriers 51, 52 and the normally-open contact carriers 53, 54 take the form of fixed contact springs. The electrical terminals 4, 5, 56, 57 take the form of pins and inside to plug the relay onto a printed circuit board and to make electrical contact with the printed circuit board.

The relay has been described as having two pairs of moveable contact springs, normally-closed contact carriers and normally-open contact carriers. Depending on the selected embodiment, however, just one contact spring, one normally-closed contact carrier and one normally-open contact carrier, or a plurality of contact springs, normally-closed contact carriers and normally-open contact carriers may also be provided.

The invention claimed is:

1. An electromagnetic relay with at least one moveable contact spring, having an assigned normally-open contact, wherein the moveable contact spring is connected electrically-conductively to a first electrical terminal and the normally-open contact is connected electrically-conductively to a further electrical terminal, having a moveably mounted actuating element to move the moveable contact spring as a function of the current flowing through the relay in contact with the normally-open contact, wherein the contact spring has first and second sides with a central longitudinal axis extending along the length of the contact spring, intermediate the first and second sides, with the first and second sides being spaced transversely from the central longitudinal axis, the contact spring and is equipped with first and second abutment surfaces, the first abutment surface being positioned adjacent to the first side and the second abutment surface being positioned adjacent to the second side, and on opposite sides of the central longitudinal axis of the contact spring, and the actuating element is equipped with two actuating members, which are provided to seat against respective abutment surfaces in order to move the contact spring, wherein the two abutment surfaces are in relation to a contact region of the contact spring, disposed on opposing sides of the contact spring, and each abutment surface is provided on a sprung arm, which are connected to a base body of the moveable contact spring, the sprung arms extend laterally out from the base body from a region beneath the contact region and are carried upwards into the region of the contact region and are disposed at the side of the contact region, preferably with equal lateral spacing from the contact region, and preferably end at an identical height with the abutment surfaces for the actuating element.

2. The electromagnetic relay according to claim 1, wherein the two abutment surfaces are disposed at an identical height in the region of the contact region of the contact spring.

3. The electromagnetic relay according to claim 1, wherein a third sprung arm is provided on the contact spring, wherein the third sprung arm is disposed above the actuating element and restricts the movement of the actuating element in an upward direction.

4. The electromagnetic relay according to claim 3, wherein the first actuating arm extends between the first and the third sprung arms.

5. The electromagnetic relay according to claim 1, wherein the contact spring is equipped with a further abutment surface, wherein a third actuating surface of the actuating element is assigned to the further abutment surface, and wherein the actuating element draws the contact spring away from the normally-open contact as a result of the seating of the third actuating surface against the further abutment surface.

6. The electromagnetic relay according to claim 5, wherein the further abutment surface is provided at the level of the contact region of the contact spring, preferably on the same side of the contact region as the second sprung arm.

7. The electromagnetic relay according to claim 1, wherein the actuating element is equipped with two actuating arms, which are equipped with actuating surfaces assigned to the abutment surfaces.

8. The electromagnetic relay according to claim 1, wherein a second moveable contact spring, which is of identical design to the first contact spring and disposed adjacent to the first contact spring, is provided, wherein the actuating element is designed to actuate the second moveable contact spring.

9. The electromagnetic relay according to claim 8, wherein the relay is covered with a housing cover, wherein the housing cover is equipped with a wall, wherein the wall is routed between the two moveable contact springs and represents an electrically insulating wall between the two contact springs.

10. The electromagnetic relay according to claim 9, wherein the actuating element and/or the housing wall is equipped with a recess, wherein the recess is disposed between the two contact springs and wherein the wall of the housing cover projects into the recess.

11. An electromagnetic relay with at least one moveable contact spring, having an assigned normally-open contact, wherein the moveable contact spring is connected electrically-conductively to a first electrical terminal and the normally-open contact is connected electrically-conductively to a further electrical terminal, having a moveably mounted actuating element to move the moveable contact spring as a function of the current flowing through the relay in contact with the normally-open contact, wherein the contact spring has first and second sides with a central longitudinal axis extending along the length of the contact spring, intermediate the first and second sides, with the first and second sides being spaced transversely from the central longitudinal axis, the contact spring and is equipped with first and second abutment surfaces, the first abutment surface being positioned adjacent to the first side and the second abutment surface being positioned adjacent to the second side, and on opposite sides of the central longitudinal axis of the contact spring, and the actuating element is equipped with two actuating members, which are provided to seat against respective abutment surfaces in order to move the contact spring, wherein a third sprung arm is provided on the contact spring, wherein the third sprung arm is disposed above the actuating element and restricts the movement of the actuating element in an upward direction.

12. The electromagnetic relay according to claim 11, wherein the contact spring is equipped with a further abutment surface, wherein a third actuating surface of the actuating element is assigned to the further abutment surface, and wherein the actuating element draws the contact spring away from the normally-open contact as a result of the seating of the third actuating surface against the further abutment surface.

13. The electromagnetic relay according to claim 12, wherein the further abutment surface is provided at the level of the contact region of the contact spring, preferably on the same side of the contact region as the second sprung arm.

14. The electromagnetic relay according to claim 11, wherein the actuating element is equipped with two actuating arms, which are equipped with actuating surfaces assigned to the abutment surfaces.

15. The electromagnetic relay according to claim 11, wherein the first actuating arm extends between the first and the third sprung arms.

16. An electromagnetic relay with at least one moveable contact spring, having an assigned normally-open contact, wherein the moveable contact spring is connected electrically-conductively to a first electrical terminal and the normally-open contact is connected electrically-conductively to a further electrical terminal, having a moveably mounted actuating element to move the moveable contact spring as a function of the current flowing through the relay in contact with the normally-open contact, wherein the contact spring has first and second sides with a central longitudinal axis extending along the length of the contact spring, intermediate the first and second sides, with the first and second sides being spaced transversely from the central longitudinal axis, the contact spring and is equipped with first and second abutment surfaces, the first abutment surface being positioned adjacent to the first side and the second abutment surface being positioned adjacent to the second side, and on opposite sides of the central longitudinal axis of the contact spring, and the actuating element is equipped with two actuating members, which are provided to seat against respective abutment surfaces in order to move the contact spring, wherein the contact spring is equipped with a further abutment surface, wherein a third actuating surface of the actuating element is assigned to the further abutment surface, and wherein the actuating element draws the contact spring away from the normally-open contact as a result of the seating of the third actuating surface against the further abutment surface.

17. The electromagnetic relay according to claim 16, wherein each abutment surface is provided on a sprung arm, which are connected to a base body of the moveable contact spring.

18. The electromagnetic relay according to claim 17, wherein the sprung arms extend laterally out from the base body from a region beneath the contact region and are carried upwards into the region of the contact region and are disposed at the side of the contact region, preferably with equal lateral spacing from the contact region, and preferably end at an identical height with the abutment surfaces for the actuating element.

19. The electromagnetic relay according to claim 16, wherein a third sprung arm is provided on the contact spring, wherein the third sprung arm is disposed above the actuating element and restricts the movement of the actuating element in an upward direction.

20. The electromagnetic relay according to claim 16, wherein the contact spring is equipped with a further abutment surface, wherein a third actuating surface of the actuating element is assigned to the further abutment surface, and wherein the actuating element draws the contact spring away from the normally-open contact as a result of the seating of the third actuating surface against the further abutment surface.

21. The electromagnetic relay according to claim 16, wherein the relay is covered with a housing cover, wherein the housing cover is equipped with a wall, wherein the wall is routed between the two moveable contact springs and represents an electrically insulating wall between the two contact springs.

22. The electromagnetic relay according to claim 21, wherein the actuating element and/or the housing wall is equipped with a recess, wherein the recess is disposed between the two contact springs and wherein the wall of the housing cover projects into the recess.

23. An electromagnetic relay with at least one moveable contact spring, having an assigned normally-open contact, wherein the moveable contact spring is connected electrically-conductively to a first electrical terminal and the normally-open contact is connected electrically-conductively to a further electrical terminal, having a moveably mounted actuating element to move the moveable contact spring as a function of the current flowing through the relay in contact with the normally-open contact, wherein the contact spring has first and second sides with a central longitudinal axis extending along the length of the contact spring, intermediate the first and second sides, with the first and second sides being spaced transversely from the central longitudinal axis, the contact spring and is equipped with first and second abutment surfaces, the first abutment surface being positioned adjacent to the first side and the second abutment surface being positioned adjacent to the second side, and on opposite sides of the central longitudinal axis of the contact spring, and the actuating element is equipped with two actuating members, which are provided to seat against respective abutment surfaces in order to move the contact spring, wherein a second moveable contact spring, which is of identical design to the first contact spring and disposed adjacent to the first contact spring, is provided, wherein the actuating element is designed to actuate the second moveable contact spring.

24. The electromagnetic relay according to claim 23, wherein the relay is covered with a housing cover, wherein the housing cover is equipped with a wall, wherein the wall is routed between the two moveable contact springs and represents an electrically insulating wall between the two contact springs.

25. The electromagnetic relay according to claim 24, wherein the actuating element and/or the housing wall is equipped with a recess, wherein the recess is disposed between the two contact springs and wherein the wall of the housing cover projects into the recess.

* * * * *